US006978765B2

(12) United States Patent
Kilgore

(10) Patent No.: US 6,978,765 B2
(45) Date of Patent: Dec. 27, 2005

(54) FUEL SYSTEM WITH PRESS FIT PLUG ASSEMBLY

(75) Inventor: Jason T. Kilgore, Newport News, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 0 days.

(21) Appl. No.: 10/831,330

(22) Filed: Apr. 26, 2004

(65) Prior Publication Data

US 2005/0235963 A1 Oct. 27, 2005

(51) Int. Cl.[7] ..... F02M 41/00
(52) U.S. Cl. ..... 123/456; 138/94
(58) Field of Search ..... 123/456, 447, 123/468, 467; 138/30, 94, 90, 89

(56) References Cited

U.S. PATENT DOCUMENTS

| | | | | |
|---|---|---|---|---|
| 3,964,339 A | | 6/1976 | Antonio et al. | 74/551.9 |
| 4,113,006 A | | 9/1978 | Clapp | 165/76 |
| 4,202,463 A | * | 5/1980 | Mogler | 220/789 |
| 4,646,816 A | | 3/1987 | Rothstein | 165/76 |
| 4,809,872 A | * | 3/1989 | Pavur | 220/789 |
| 4,823,411 A | | 4/1989 | Nettel | 4/255 |
| 5,044,338 A | | 9/1991 | Shelton | 123/469 |
| 5,160,226 A | | 11/1992 | Lee et al. | 411/72 |
| 5,370,252 A | * | 12/1994 | Parsons et al. | 215/247 |
| 5,617,827 A | * | 4/1997 | Eshleman et al. | 123/456 |
| 5,779,085 A | | 7/1998 | Havlinek et al. | 220/234 |
| 5,944,057 A | | 8/1999 | Pierce | 138/89 |
| 6,148,797 A | | 11/2000 | Gmelin | 123/456 |
| 6,321,719 B1 | | 11/2001 | Schwegler | 123/467 |
| 6,520,155 B1 | * | 2/2003 | Boecking | 123/456 |
| 2002/0043249 A1 | | 4/2002 | Lee et al. | 123/456 |

* cited by examiner

*Primary Examiner*—Mahmoud Gimie

(57) ABSTRACT

A press fit plug assembly used to seal a fuel rail in which a pressure pulsation damper is inserted. The fuel rail includes an elongated member, a first member, and a second member. The elongated member extends along a longitudinal axis, the first member being positioned within the elongated member, with at least one inward projection extending toward the longitudinal axis. The second member, positioned within the first member, has at least one outward projection extending away from the longitudinal axis. The outward projection engages the inward projection between the first member end and the inward projection. A method of assembling a pressure pulsation damper within a passage of a fuel rail is achieved by forming a first seal between the fuel rail and a first member; inserting the pressure pulsation damper through the first member; and forming a second seal between the first member and a second member.

18 Claims, 2 Drawing Sheets

FUEL SYSTEM WITH PRESS FIT PLUG ASSEMBLY

BACKGROUND OF THE INVENTION

In known fuel rails for injector-based fuel injection systems, a pressure pulsation damper is believed to be used in fuel rail assemblies. Insertion of the pressure pulsation damper into the fuel rail assembly is typically accomplished by placing the pressure pulsation damper through an open end of the fuel rail. The open end of the fuel rail is believed to be sealed in order to prevent fuel leakage from the fuel rail i.e., a hermetic seal. The open end of the fuel rail is believed to be sealed by conventional soldering, induction welding, resistance welding, or the more well-established use of crimping an assembly that utilizes an O-ring joint. The O-ring joint use is believed to be prone to excessive evaporative emissions. The other techniques are believed to require excessive heat or electricity in order to seal the fuel rail. The excessive heat generated by some of these techniques may damage the pressure pulsation damper thereby rendering the internal damper unsuitable in damping pressure pulsations.

A known pressure plug assembly uses a cup-shaped sealing cap with a bellow damper attached to reduce pressure fluctuations in the fuel rail. The sealing cap compresses an O-ring joint against a connecting sleeve and is crimped to the connecting sleeve at its radial flange. As previously mentioned, this configuration is prone to excessive evaporative emissions that reduce its effectiveness.

Another known pressure plug assembly uses a deformable cylindrical sleeve member which is placed into a tube end. The sleeve's peripheral shoulder abuts against the tube end to position an interior tapered portion of the sleeve. Adjacent the open-end, at the desired location of the seal to be formed within the tube, a hard plug member having a tapered portion, is pressed into the tapered portion of the sleeve to deform the sleeve and form the tube seal in the zone of the tapered surfaces. Neither the deformable cylindrical sleeve nor the hard plug member shows any outward or inward projections that are pressed against each other to seal the tube Still another known plug assembly for pressurized piping utilizes a bore plug that fits into an enlarged end of a heat exchanger tube. The bore plug is believed to have a sealing member that fits into the heat exchanger tube and a holding member that interlocks with the sealing member. The sealing member is tapered and includes three circumferential indentations along its longitudinal axis that interlock with the circumferential projection of the holding member. The holding member is manually pressed into the sealing member and locks into place at one of the three indentation positions.

SUMMARY OF THE INVENTION

Briefly, the present invention provides a plug assembly to seal an opening in an elongated member. In one aspect, a fuel rail is provided. The fuel rail includes an elongated member, a first member, and a second member. The elongated member extends along a longitudinal axis between a first and a second end defining a first passageway therebetween. The first member has a first wall surface with at least one inward projection extending from the first wall surface toward the longitudinal axis defining a second passageway. The second member is disposed in the second passageway and has a second wall. The second wall has an outer surface with at least one outward projection extending away from the longitudinal axis and contiguous to the first wall surface between the first end and the at least one inward projection. The second member is shaped as a blind hole with its outer surface surrounding its internal surface about the longitudinal axis.

In another aspect, a fuel rail is provided. The fuel rail includes an elongated member, a first member, a securement, and a second member. The elongated member extends between a first end and a second end along a longitudinal axis. The elongated member defines a first passageway therebetween. The first member is disposed in the first passageway proximate the first end. The first member has a first wall surface defining a second passageway. The first wall includes at least one first projection. The securement is formed between the first member and the first passageway. The second member is disposed in the second passageway. The second member has a second wall defining a blind hole. The second wall has an outer surface surrounding an internal surface about the longitudinal axis and contiguous to the at least one first projection. The second wall includes at least one second projection contiguous to the first wall surface.

In yet another aspect, the present invention provides a plug assembly for sealing a fluid passage in a fuel rail. The plug assembly includes a first and second member. The first member extends between a first member end and a second member end along a longitudinal axis. The first member has a first wall. The first wall includes at least one inward projection extending from a first wall surface towards the longitudinal axis. Inside the first member, the second member has a second wall with at least one outward projection extending away from the longitudinal axis on an outer surface and contiguous to the first wall surface. The outward projection is located between the first member end and the at least one inward projection.

In a further aspect, the present invention also provides a method of assembling a pressure pulsation damper within a passage of a fuel rail extending along a longitudinal axis. The method can be achieved by forming a first seal between the fuel rail and a first sleeve located inside the passage; inserting the pressure pulsation damper through the first sleeve into the passage; and forming a second seal between the first sleeve and a second sleeve.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1:
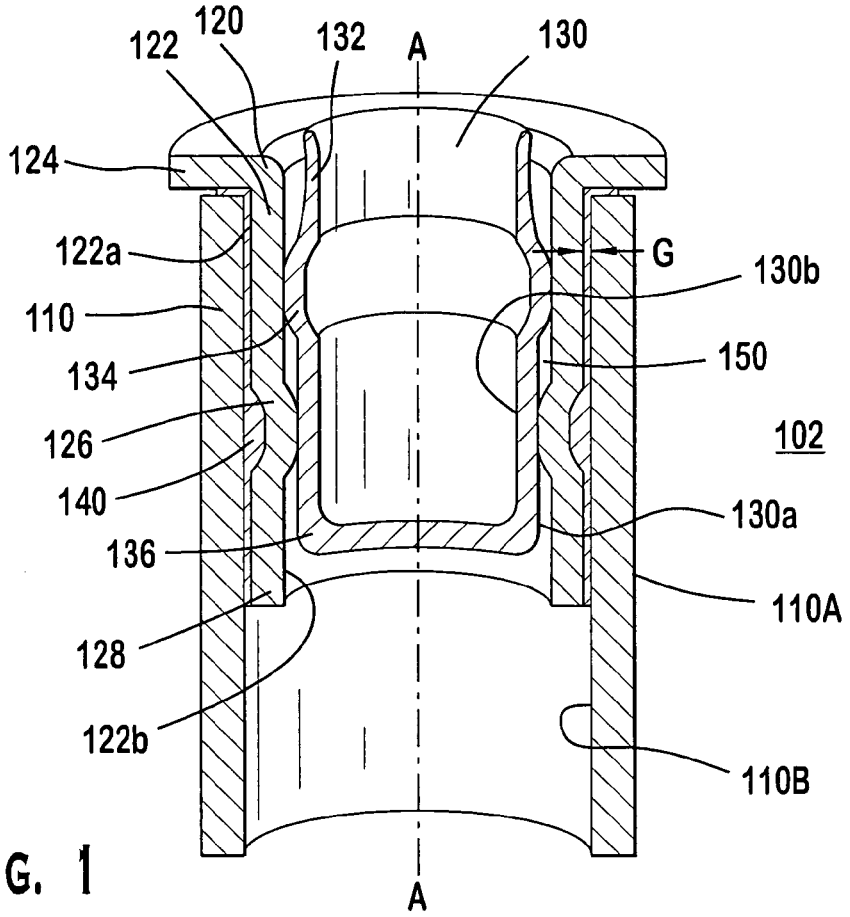
FIG. 1 is a cross-sectional view of a fuel rail assembly according to a preferred embodiment.

FIGS. 1–5 illustrate the preferred embodiments. There is shown a press fit plug assembly 100 for a fuel rail assembly 102 that prevents the passage of fuel from the fuel rail 110. The plug assembly 100 includes an outer sleeve 120 and an inner sleeve 130 in a preferred embodiment. The fuel rail 110 can be of any suitable cross-sectional configuration such as rectangular, hexagonal, or triangular tubing with an outer surface 110*a* and an inner surface 110*b*. The fuel rail 110 may be made of any number of suitable materials such as steel, aluminum, or copper tubing so long as the material provides for transport of fuel to the fuel injectors (not shown). However, generally circular stainless steel tubing with an internal diameter of less than 20 millimeters is preferred.

Figure 3A:
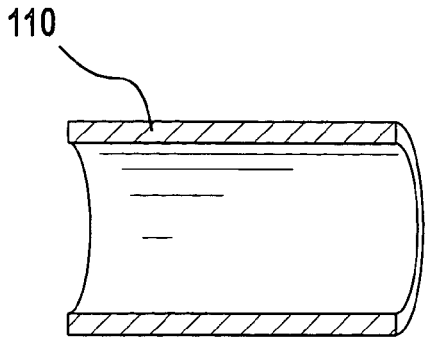
FIG. 3A is a cross-sectional view of the fuel rail end before assembly in the preferred embodiment.
Figure 3B:
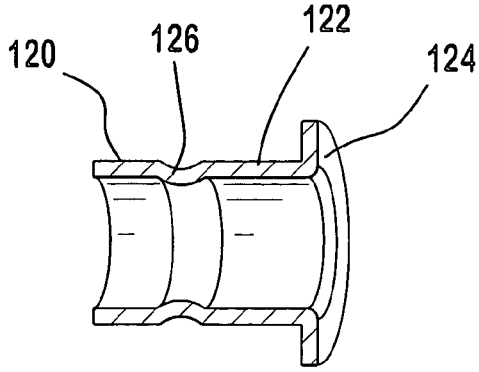
FIG. 3B is a cross-sectional view of an outer sleeve before assembly of the outer sleeve into the fuel rail in the preferred embodiment.

Preferably, the outer sleeve 120 is generally cylindrical in shape with a first sleeve end 128 and second sleeve end 124, and an outside diameter of an outer surface 122*a* and inner surface 122*b* less than that of the fuel rail 110. Both the fuel rail 110 and the outer sleeve 120 are orientated about the same longitudinal axis, A—A, as shown in FIG. 1. The outer sleeve 120 can be disposed inside the fuel rail 110. In one embodiment, a flange-shaped second sleeve end 124 is oriented substantially perpendicular to the longitudinal axis and extended beyond the outer diameter of the fuel rail 110. The outer sleeve 120 has an inward facing protrusion 126 circumscribing preferably about its mid-section, to define a portion of a torus about the longitudinal axis (FIG. 3B). The inward facing protrusion 126 can extend toward the longitudinal axis from a wall 122 of the outer sleeve 120. The outer sleeve 120 can form a seal by contact with the inner surface 110*b* via an interference fit, i.e., a press-fit. In a preferred embodiment, a gap "G" can be provided to the outer surface 122*a* and the inner surface 110*b*. Preferably the outer sleeve 120 has an outer diameter about 17 millimeters, an inner diameter about 16 millimeters, and an inward facing protrusion diameter about 15 millimeters. The overall length of the outer sleeve 120 is preferably about 19 millimeters.

Figure 4A:
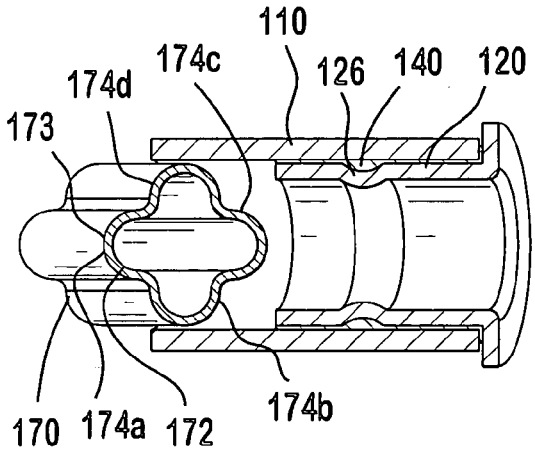
FIG. 4A is a cross-sectional view of a pre-assembly of the fuel rail and the outer sleeve brazed together in the preferred embodiment.

The gap "G" can be filled by a suitable securement 140. The securement 140 may include a suitable material such as, for example, a glue, an epoxy resin, solder, brazing, or a weld that bonds the outer sleeve 120 and the fuel rail 110 together to provide a hermetic seal. Preferably, the securement 140 is a copper-braze that fills a substantial portion of the length of the outer sleeve 120 along the longitudinal axis as shown in FIG. 4A.

Figure 4B:
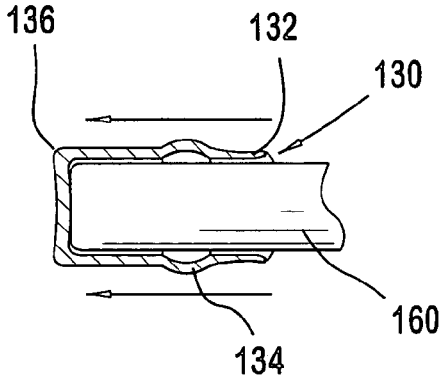
FIG. 4B is a cross-sectional view of an inner sleeve and mandrel before assembly of the inner sleeve into the pre-assembly of the preferred embodiment.

FIG. 4B shows an inner sleeve 130 that is disposed within the outer sleeve 120 to complete the press-fit plug assembly 100. Preferably, the inner sleeve 130 can be shaped like a narrow cylindrical thimble with an outer surface 130*a* and an inner surface 130*b*. The inner sleeve 130 includes a closed-end 136 and an open end 132 similar to a blind hole. The inner sleeve 130 has an outward facing protrusion 134 circumscribing its mid-section to define a portion of a torus about the longitudinal axis. The outward facing protrusion 134, extends from the outer wall of the inner sleeve 130 away from the longitudinal axis. The outer diameter of the inner sleeve 130 is preferably about 15 millimeters and the diameter of the outward facing protrusion is about 16 millimeters. The overall length of the inner sleeve 130 is preferably about 18 millimeters.

Figure 5:
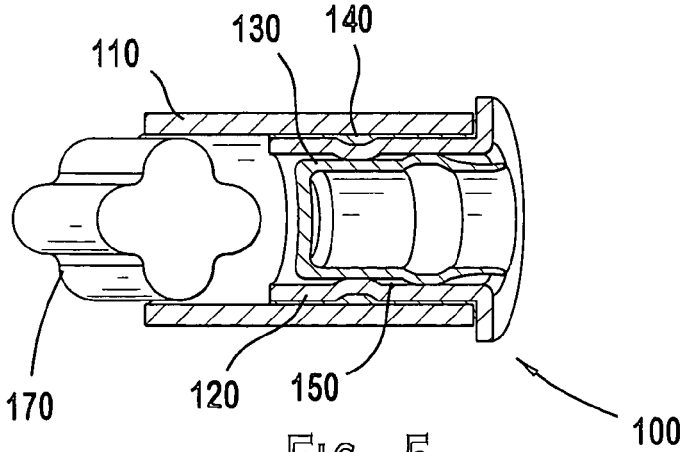
FIG. 5 is a cross-sectional view of a final-assembly of the preferred embodiment.

The inner sleeve 130 may be pressed into the outer sleeve 120 by a device such as a mandrel 160. The mandrel 160 is removed after the inner sleeve 130 is press fit into the outer sleeve 120 (FIGS. 4B and 5). As used herein, a press fit operation is one that converts the axial force exerted by the mandrel 160 into a compressive hoop force on the inner sleeve 130 and a tensile hoop force on the outer sleeve 120 to provide a permanent seal. As a result, a hermetic seal is created when the inward facing protrusion 126 of the outer sleeve 120 is forced against the outward facing protrusion 134 of the inner sleeve 130. An air gap 150 may be created between the inward facing protrusion 126 and the outward facing protrusion 134 when pressed together. The air gap 150 is believed to be useful for containing particles of material sheared from the inward and outward protrusions when the axial force is applied during the press fit operation. In FIG. 5, an assembled press fit plug assembly 100 for a fuel rail assembly 102 as above-described is shown.

Figure 2:
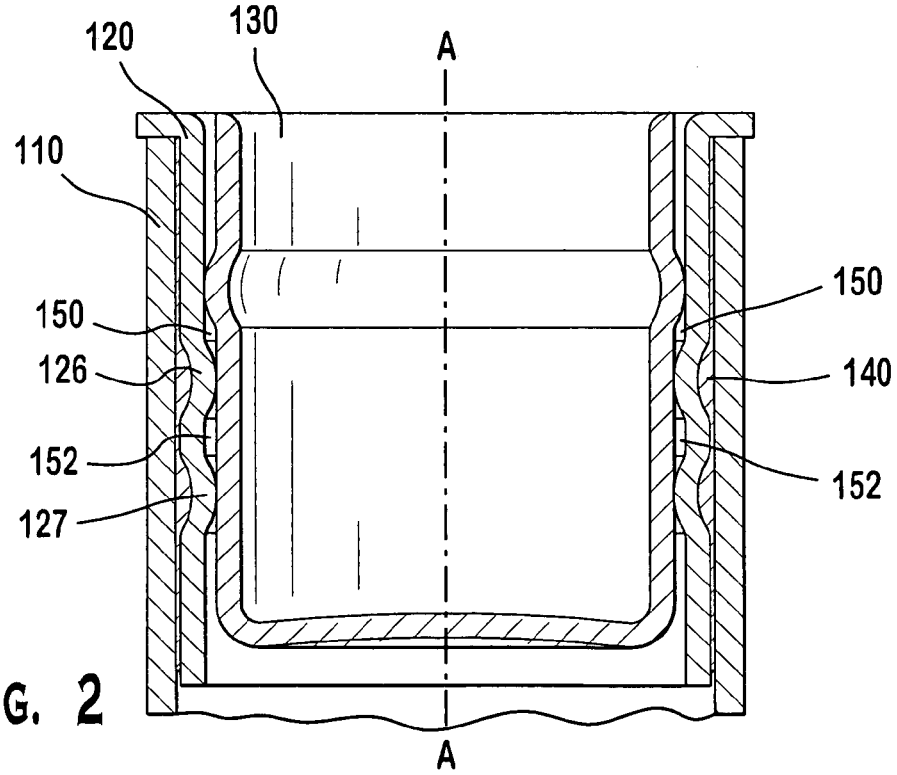
FIG. 2 is a cross-sectional view of another preferred embodiment of a fuel rail assembly.

It is believed that the use of multiple inward projections can provide for redundancy in the seal while lowering the amount of pressure necessary for the press fit. FIG. 2 shows a second embodiment where the outer sleeve 120 includes at least two inwardly facing protrusions 126 and 127 that circumscribe the outer sleeve's mid-section, one above the other. The inwardly facing protrusions 126 and 127 extend toward the longitudinal axis from the inner wall 122 of the outer sleeve 120. The protrusions perform the same sealing function above-mentioned, but they create a second air gap 152 to hermetically seal the passage of fuel from the fuel rail 110. The inner sleeve 130 and the outer sleeve 120 of both embodiments may be made of materials such as steel, aluminum, or copper, but they are preferably made of stainless steel. The inner sleeve 130 may also be made from brass, bronze, or an elastomer. However, if the inner sleeve 130 is made from brass, bronze, elastomer, polymer or combinations thereof, it is preferably made as a solid plug without a blind hole.

The method of assembling a pressure pulsation damper 170 within a passage of a fuel rail can be achieved by forming the first seal between the fuel rail 110 and the outer sleeve 120. The first seal is preferably bonded by copper brazing. The pressure pulsation damper 170 can then be inserted through the outer sleeve 120 into the fuel rail 110 after the brazing is completed. Applicant has discovered that the brazing of a fuel rail 110 with the fuel damper 170 disposed in the fuel rail could result in damage to the fuel damper 170. By utilization of the sealing assembly 100, damage to the fuel damper 170 is believed to be alleviated.

The pressure pulsation damper 170 can be configured into many shapes and configurations. In one embodiment, as shown in FIG. 4A, one end of the damper 170 is illustrated as a cut-away cross section to show the internal volume of the damper. The internal volume can be filled with a suitable medium, such as, for example, air and hermetically sealed (FIG. 5) from the fuel flowing through the fuel rail. In the preferred embodiment, the pressure pulsation damper 170 can be generally cylindrically shaped with one continuous surface 173 and four semi-elliptical portions or lobes 174 (*a*–*d*) running the length of the damper along the longitudinal axis. The pressure pulsation damper 170 may be configured such that fuel flows between an inner surface 10*b* of the fuel rail 110 and the one continuous surface 173. The one continuous surface 173 may be configured with at least a first section located at a greatest distance from the longitudinal axis, the at least first section having a uniform radius of curvature about the longitudinal axis. The pressure pulsation damper 170 may be hollow inside and made from a suitable material such as metals, polymers or any material sufficiently resilient to deform when affected by pressure pulses when provided in an installed configuration shown, for example, in FIG. 5. The pressure pulsation damper can include a body formed from a ferrous material and preferably stainless steel. Similar pressure pulsation dampers are described in U.S. Pat. No. 6,314,942 to Kilgore et al., which is incorporated herein by reference.

Because the brazing can be performed before the pressure pulsation damper 170 is inserted, it is believed that the pressure pulsation damper 170 would not be damaged as the assembly of the pressure pulsation damper 170 into the fuel rail 110 occurs after brazing is complete. A second seal formed by the respective protrusions of the inner and outer sleeves can be provided by press fitting the inner sleeve 130 into the outer sleeve 120 (FIGS. 3–5).

Although the preferred embodiments have been described in relation to a fuel rail, the preferred embodiments can be utilized to seal any elongated member having a passage extending therethrough, such as, for example, a fluid pipe or a radiator core.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A fuel rail comprising:

an elongated member extending between a first end and a second end along a longitudinal axis, the member defining a first passageway therebetween;

a first member disposed in the first passageway proximate the first end, the first member having a first wall surface defining a second passageway, the first wall including at least one inward projection extending from the first wall surface of the first member towards the longitudinal axis; and a second member disposed in the second passageway, the second member having a second wall defining a blind hole including a closed-end proximate the second end and an open-end proximate the first end, the second wall having an outer surface surrounding an internal surface about the longitudinal axis, the second wall including at least one outward projection extending away from the longitudinal axis and contiguous to the first wall surface between the first end and the at least one inward projection.

2. The fuel rail of claim 1, wherein the elongated member comprises a tubular fuel rail having an internal diameter of about 20 millimeters.

3. The fuel rail of claim 2, wherein the first member comprises a sleeve extending between a first sleeve end and a second sleeve end, the sleeve including the first wall having an external diameter less than the internal diameter of the fuel rail.

4. The fuel rail of claim 3, wherein the second sleeve end comprises a flange portion defining a generally planar surface about the longitudinal axis.

5. A fuel rail comprising:

a tubular fuel rail having an internal diameter and extending along a longitudinal axis between first and second ends, the tubular fuel rail defining a first passageway therebetween;

a sleeve extending between first and second sleeve ends and disposed in the first passageway proximate the first end, the sleeve including a first wall having an external diameter less than the internal diameter of the fuel rail, and the sleeve having a first wall surface defining a second passageway, the first wall including at least one inward projection extending from the first wall surface of the sleeve towards the longitudinal axis;

a member disposed in the second passageway, the member having a second wall defining a blind hole, the second wall having an outer surface surrounding an internal surface about the longitudinal axis, the second wall including at least one outward projection extending away from the longitudinal axis and contiguous to the first wall surface between the first end and the at least one inward projection; and a sealant disposed in a gap defined by the internal diameter of the fuel rail and the external diameter of the sleeve.

6. The fuel rail of claim 5, wherein the sealant comprises a copper brazing.

7. The fuel rail of clam 6, wherein the member comprises a plug extending between a first plug end and a second plug end, the plug having an outer diameter less than either of the external diameter of the sleeve or the internal diameter of the fuel rail.

8. The fuel rail of claim 7, wherein the outer diameter of the plug comprises a diameter of about 10 millimeters.

9. The fuel rail of claim 7, wherein the at least one inward projection comprises two inward projections spaced apart along the longitudinal axis, each inward projection circumscribing the longitudinal axis.

10. The fuel rail of claim 9, wherein the at least one outward projection circumscribes the longitudinal axis.

11. The fuel rail of claim 9, further comprising a fuel damper element disposed within the fuel rail, the damper element having one continuous surface with a plurality of radius of curvature with respect to the longitudinal axis, the fuel damper element configured such that fuel flows between an inner surface of the fuel rail and the one continuous surface, the one continuous surface includes at least a first section located at a greatest distance from the longitudinal axis, the at least first section having a uniform radius of curvature about the longitudinal axis.

12. The fuel rail of claim 1, further comprising a fuel damper disposed within the fuel rail, the fuel damper having a stainless steel body.

13. A fuel rail comprising:

an elongated member extending between a first end and a second end along a longitudinal axis, the member defining a first passageway therebetween;

a first member disposed in the first passageway proximate the first end, the first member having a first wall surface defining a second passageway, the first wall including at least one first projection;

a securement formed between the first member and the first passageway; and a second member disposed in the second passageway, the second member having a second wall defining a blind hole including a closed-end proximate the second end and an open-end proximate the first end, the second wall having an outer surface surrounding an internal surface about the longitudinal axis and contiguous to the at least one first projection, the second wall including at least one second projection contiguous to the first wall surface.

14. A plug assembly for sealing a fluid passage comprising;

a first member extending between a first member end and a second member end along a longitudinal axis, the first member having a first wall surface defining a passageway, the first wall including at least one inward projection extending from the first wall surface of the first member towards the longitudinal axis; and a second member disposed in the passageway, the second member having a second wall defining a blind hole including a closed-end proximate the second member end and an open-end proximate the first member end, the second wall having an outer surface surrounding an internal surface about the longitudinal axis, the second wall including at least one outward projection extending away from the longitudinal axis and contiguous to the first wall surface between the first end and the at least one inward projection.

15. The plug assembly of claim 14, wherein the first member comprises a sleeve having a first internal diameter and extending between a first sleeve end and a second sleeve end having a flared portion.

16. The plug assembly of claim 15, wherein the second member comprises a plug extending between a first plug end and a second plug end, the plug having an outer diameter less than the first internal diameter.

17. The plug assembly of claim 16, wherein the outer diameter of the plug comprises a diameter of about 10 millimeters.

18. The plug assembly of claim 15, wherein the at least one inward projection comprises two inward projections spaced apart along the longitudinal axis, each inward projection surrounding the longitudinal axis.

* * * * *